US009389560B2

(12) United States Patent
Hirose et al.

(10) Patent No.: US 9,389,560 B2
(45) Date of Patent: Jul. 12, 2016

(54) FIXING DEVICE INCLUDING A SEPARATOR TO SEPARATE A RECORDING MEDIUM FROM A PRESSURE ROTATOR AND IMAGE FORMING APPARATUS INCLUDING THE FIXING DEVICE

(71) Applicants: Fumihiro Hirose, Kanagawa (JP); Masami Okamoto, Kanagawa (JP); Kenji Nozawa, Kanagawa (JP); Yuuki Kikushima, Kanagawa (JP); Kensuke Yamaji, Kanagawa (JP); Keisuke Kubota, Kanagawa (JP); Shuutaroh Yuasa, Kanagawa (JP); Kaori Hemmi, Kanagawa (JP)

(72) Inventors: Fumihiro Hirose, Kanagawa (JP); Masami Okamoto, Kanagawa (JP); Kenji Nozawa, Kanagawa (JP); Yuuki Kikushima, Kanagawa (JP); Kensuke Yamaji, Kanagawa (JP); Keisuke Kubota, Kanagawa (JP); Shuutaroh Yuasa, Kanagawa (JP); Kaori Hemmi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/829,947

(22) Filed: Aug. 19, 2015

(65) Prior Publication Data

US 2016/0070218 A1 Mar. 10, 2016

(30) Foreign Application Priority Data

Sep. 5, 2014 (JP) ..... 2014-181301

(51) Int. Cl.
*G03G 15/20* (2006.01)

(52) U.S. Cl.
CPC ..... *G03G 15/2085* (2013.01)

(58) Field of Classification Search
CPC ..... G03G 15/2085
USPC ..... 399/331, 329
See application file for complete search history.

(56) References Cited

U.S. PATENT DOCUMENTS

| | | | | |
|---|---|---|---|---|
| 2009/0003897 | A1 | 1/2009 | Yamada | |
| 2010/0086334 | A1 | 4/2010 | Sakaya | |
| 2011/0164904 | A1* | 7/2011 | Hirose | G03G 15/2028 399/323 |
| 2011/0222926 | A1 | 9/2011 | Ueno et al. | |
| 2012/0044516 | A1 | 2/2012 | Hirose et al. | |
| 2012/0207523 | A1 | 8/2012 | Ueno et al. | |
| 2013/0051835 | A1* | 2/2013 | Kubo | G03G 21/206 399/92 |
| 2013/0170880 | A1 | 7/2013 | Gotoh et al. | |

FOREIGN PATENT DOCUMENTS

| | | |
|---|---|---|
| JP | 2002-091222 | 3/2002 |
| JP | 2006-119677 | 5/2006 |

(Continued)

*Primary Examiner* — Quana M Grainger
(74) *Attorney, Agent, or Firm* — Harness, Dickey & Pierce, P.L.C.

(57) ABSTRACT

A fixing device includes a guide disposed downstream from a fixing nip formed between a fixing rotator and a pressure rotator, through which a recording medium is conveyed. A pressure rotator side separator, disposed downstream from the fixing nip in a recording medium conveyance direction, includes an opposed tip disposed opposite an outer circumferential surface of the pressure rotator and a separation-conveyance face that separates the recording medium from the pressure rotator. The opposed tip and the separation-conveyance face define a hypothetical circle having a curvature not smaller than 1/20 that intersects a guide face of the guide at an intersection at which a hypothetical tangent is tangent to the hypothetical circle. The hypothetical tangent and the guide face define a downstream intersection angle that is downstream from the hypothetical tangent in the recording medium conveyance direction and is greater than 90 degrees.

20 Claims, 5 Drawing Sheets

(56) References Cited

FOREIGN PATENT DOCUMENTS

| | | |
|---|---|---|
| JP | 2009-031759 | 2/2009 |
| JP | 2009-258328 | 11/2009 |
| JP | 2010-085895 | 4/2010 |
| JP | 2011-191388 | 9/2011 |
| JP | 2012-063742 | 3/2012 |
| JP | 2012-098704 | 5/2012 |
| JP | 2012-168434 | 9/2012 |
| JP | 2013-137471 | 7/2013 |
| JP | 2014-059521 | 4/2014 |
| JP | 2014-078048 | 5/2014 |
| JP | 2014-178487 | 9/2014 |
| JP | 2014-199382 | 10/2014 |

* cited by examiner

FIXING DEVICE INCLUDING A SEPARATOR TO SEPARATE A RECORDING MEDIUM FROM A PRESSURE ROTATOR AND IMAGE FORMING APPARATUS INCLUDING THE FIXING DEVICE

CROSS-REFERENCE TO RELATED APPLICATION

This patent application is based on and claims priority pursuant to 35 U.S.C. §119 to Japanese Patent Application No. 2014-181301, filed on Sep. 5, 2014, in the Japanese Patent Office, the entire disclosure of which is hereby incorporated by reference herein.

BACKGROUND

1. Technical Field

Example embodiments generally relate to a fixing device and an image forming apparatus, and more particularly, to a fixing device for fixing a toner image on a recording medium and an image forming apparatus incorporating the fixing device.

2. Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

At least one embodiment provides a novel fixing device that includes a fixing rotator rotatable in a given direction of rotation and a pressure rotator pressed against the fixing rotator to form a fixing nip therebetween, through which a recording medium bearing a toner image is conveyed. A guide is disposed downstream from the fixing nip in a recording medium conveyance direction and disposed opposite a fixing side of the recording medium that is disposed opposite the fixing rotator. The guide includes a guide face to guide the recording medium ejected from the fixing nip. A pressure rotator side separator is disposed downstream from the fixing nip in the recording medium conveyance direction. The pressure rotator side separator includes an opposed tip disposed opposite an outer circumferential surface of the pressure rotator and a separation-conveyance face to separate the recording medium from the pressure rotator. The opposed tip and the separation-conveyance face of the pressure rotator side separator define a hypothetical circle having a curvature not smaller than 1/20 that intersects the guide face of the guide at an intersection at which a hypothetical tangent is tangent to the hypothetical circle. The hypothetical tangent and the guide face of the guide define a downstream intersection angle that is downstream from the hypothetical tangent in the recording medium conveyance direction and is greater than 90 degrees.

At least one embodiment provides a novel image forming apparatus that includes an image bearer to bear a toner image and a fixing device, disposed downstream from the image bearer in a recording medium conveyance direction, to fix the toner image on a recording medium. The fixing device includes a fixing rotator rotatable in a given direction of rotation and a pressure rotator pressed against the fixing rotator to form a fixing nip therebetween, through which the recording medium bearing the toner image is conveyed. A guide is disposed downstream from the fixing nip in the recording medium conveyance direction and disposed opposite a fixing side of the recording medium that is disposed opposite the fixing rotator. The guide includes a guide face to guide the recording medium ejected from the fixing nip. A pressure rotator side separator is disposed downstream from the fixing nip in the recording medium conveyance direction. The pressure rotator side separator includes an opposed tip disposed opposite an outer circumferential surface of the pressure rotator and a separation-conveyance face to separate the recording medium from the pressure rotator. The opposed tip and the separation-conveyance face of the pressure rotator side separator define a hypothetical circle having a curvature not smaller than 1/20 that intersects the guide face of the guide at an intersection at which a hypothetical tangent is tangent to the hypothetical circle. The hypothetical tangent and the guide face of the guide define a downstream intersection angle that is downstream from the hypothetical tangent in the recording medium conveyance direction and is greater than 90 degrees.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
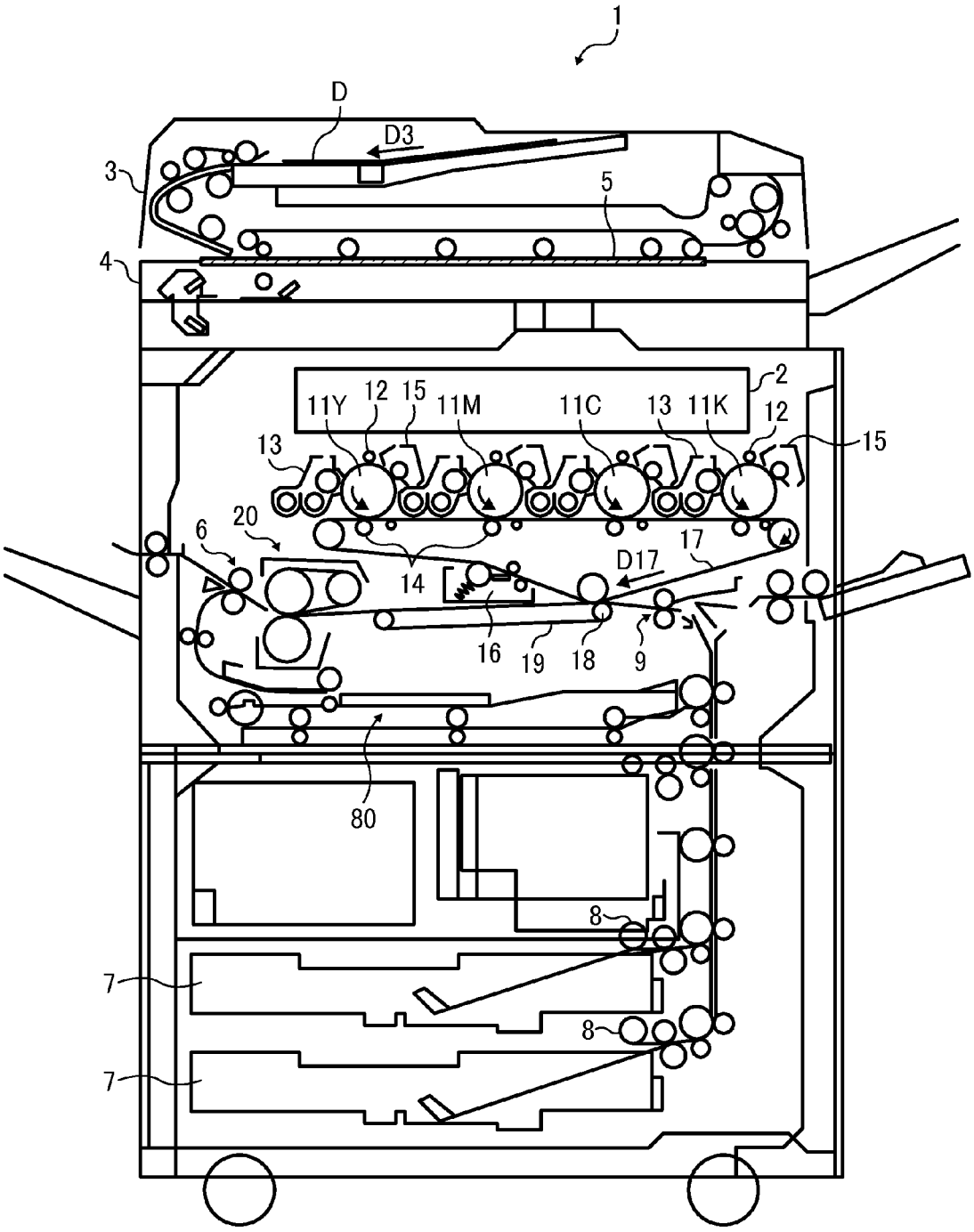
FIG. 1 is a schematic vertical sectional view of an image forming apparatus according to an example embodiment of the present disclosure.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors used herein are interpreted accordingly.

Although the terms first, second, and the like may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present disclosure.

The terminology used herein is for the purpose of describing particular embodiments only and is not intended to be limiting of the present disclosure. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 1 is a tandem color copier that forms color and monochrome toner images on recording media by electrophotography. Alternatively, the image forming apparatus 1 may be a monochrome copier that forms monochrome toner images.

With reference to FIG. 1, a description is provided of a construction of the image forming apparatus 1.

It is to be noted that identical reference numerals are assigned to identical components or equivalents and description of those components is simplified or omitted.

A description is provided of a construction of the image forming apparatus 1.

As shown in FIG. 1, the image forming apparatus 1 includes a writer 2, an auto document feeder (ADF) 3, an original reader 4, a plurality of paper trays 7, a registration roller pair 9, a plurality of photoconductive drums 11Y, 11M, 11C, and 11K, each of which serves as an image bearer, a plurality of chargers 12, a plurality of developing devices 13, a plurality of primary transfer bias rollers 14, a plurality of cleaners 15, and an intermediate transfer belt 17.

The ADF 3 feeds an original D to the original reader 4. The original reader 4 reads an image on the original D into image data. The charger 12 charges an outer circumferential surface of the respective photoconductive drums 11Y, 11M, 11C, and 11K. The writer 2 emits a laser beam onto the charged outer circumferential surface of the respective photoconductive drums 11Y, 11M, 11C, and 11K according to the image data to form an electrostatic latent image thereon. The developing device 13 develops the electrostatic latent image formed on the respective photoconductive drums 11Y, 11M, 11C, and 11K into a toner image (e.g., yellow, magenta, cyan, and black toner images). The primary transfer bias rollers 14 primarily transfer the yellow, magenta, cyan, and black toner images formed on the photoconductive drums 11Y, 11M, 11C, and 11K, respectively, onto the intermediate transfer belt 17 such that the yellow, magenta, cyan, and black toner images are superimposed on a same position on the intermediate transfer belt 17 to form a color toner image thereon. Each of the paper trays 7 loads a plurality of recording media (e.g., sheets). The cleaner 15 removes and collects residual toner failed to be transferred onto the intermediate transfer belt 17 and therefore remaining on the respective photoconductive drums 11Y, 11M, 11C, and 11K therefrom. The registration roller pair 9 adjusts a time to convey the recording medium to the intermediate transfer belt 17.

The image forming apparatus 1 further includes a secondary transfer bias roller 18, an intermediate transfer belt cleaner 16, a conveyance belt 19, a fixing device 20, a conveyance roller pair 6, and a duplex device 80. The secondary transfer bias roller 18 secondarily transfers the color toner image formed on the intermediate transfer belt 17 onto the recording medium conveyed by the registration roller pair 9. The intermediate transfer belt cleaner 16 removes residual toner failed to be transferred onto the recording medium and therefore remaining on the intermediate transfer belt 17 therefrom. The conveyance belt 19 conveys the recording medium bearing the color toner image to the fixing device 20. The fixing device 20 fixes the color toner image, that is, the unfixed toner image, on the recording medium. The conveyance roller pair 6 conveys the recording medium bearing the fixed color toner image to an outside of the image forming apparatus 1 or the duplex device 80. The duplex device 80 conveys the recording medium bearing the fixed color toner image on a front side thereof to the registration roller pair 9 for duplex printing.

A description is provided of image forming processes of the image forming apparatus 1 to form a color toner image on a recording medium.

A plurality of conveyance rollers of the ADF 3 conveys an original D placed on an original tray in a direction D3 onto an exposure glass 5 of the original reader 4. The original reader 4 optically reads an image on the original D placed on the exposure glass 5.

For example, light emitted from a light source (e.g., a lamp) of the original reader 4 irradiates and scans the original D placed on the exposure glass 5. The light reflected by the original D is reflected by a plurality of mirrors, travels through a lens, and enters a color sensor that forms an image. The color sensor reads the image into color separation light in red (R), green (G), and blue (B) and converts the light into electric signals. An image processor of the original reader 4 performs a plurality of processing including color conversion processing, color correction processing, and spatial frequency correction processing according to the electric signals to create yellow, magenta, cyan, and black image data.

The yellow, magenta, cyan, and black image data is sent to the writer 2. The writer 2 emits laser beams (e.g., exposure light beams) onto the photoconductive drums 11Y, 11M, 11C, and 11K according to the yellow, magenta, cyan, and black image data, respectively.

Each of the four photoconductive drums 11Y, 11M, 11C, and 11K rotates counterclockwise in FIG. 1. The chargers 12 disposed opposite the photoconductive drums 11Y, 11M, 11C, and 11K uniformly charge the outer circumferential surface of the photoconductive drums 11Y, 11M, 11C, and 11K, respectively, in a charging process. Thus, a charging potential is produced on each of the photoconductive drums 11Y, 11M, 11C, and 11K. Thereafter, the charged outer circumferential surface of the respective photoconductive drums 11Y, 11M, 11C, and 11K reaches an irradiation position disposed opposite the writer 2 where a laser beam emitted from the writer 2 irradiates each of the photoconductive drums 11Y, 11M, 11C, and 11K.

Four light sources of the writer 2 emit laser beams corresponding to the yellow, magenta, cyan, and black image data onto the photoconductive drums 11Y, 11M, 11C, and 11K through separate optical paths, respectively, in an exposure process.

For example, a laser beam corresponding to the yellow image data irradiates the outer circumferential surface of the leftmost photoconductive drum 11Y. A polygon mirror rotated at high speed directs the laser beam corresponding to the yellow image data to cause the laser beam to scan the photoconductive drum 11Y in an axial direction thereof, that is, a main scanning direction. Thus, an electrostatic latent image corresponding to the yellow image data is formed on the photoconductive drum 11Y charged by the charger 12.

Similarly, a laser beam corresponding to the magenta image data irradiates the outer circumferential surface of the second photoconductive drum 11M from the left in FIG. 1, forming an electrostatic latent image corresponding to the magenta image data. A laser beam corresponding to the cyan image data irradiates the outer circumferential surface of the third photoconductive drum 11C from the left in FIG. 1, forming an electrostatic latent image corresponding to the cyan image data. A laser beam corresponding to the black image data irradiates the outer circumferential surface of the fourth photoconductive drum 11K from the left in FIG. 1, forming an electrostatic latent image corresponding to the black image data.

Thereafter, the outer circumferential surface of the respective photoconductive drums 11Y, 11M, 11C, and 11K bearing the electrostatic latent image reaches a developing position disposed opposite the developing device 13. The developing devices 13 supply yellow, magenta, cyan, and black toners to the photoconductive drums 11Y, 11M, 11C, and 11K, developing the electrostatic latent images formed on the photoconductive drums 11Y, 11M, 11C, and 11K into yellow, magenta, cyan, and black toner images, respectively, in a developing process.

Thereafter, the toner image formed on the respective photoconductive drums 11Y, 11M, 11C, and 11K reaches a primary transfer position disposed opposite the intermediate transfer belt 17. The primary transfer bias rollers 14 disposed opposite the photoconductive drums 11Y, 11M, 11C, and 11K via the intermediate transfer belt 17 contact an inner circumferential surface of the intermediate transfer belt 17 to form four primary transfer nips between the intermediate transfer belt 17 and the photoconductive drums 11Y, 11M, 11C, and 11K, respectively. At the primary transfer nips, the yellow, magenta, cyan, and black toner images formed on the photoconductive drums 11Y, 11M, 11C, and 11K are primarily transferred onto the intermediate transfer belt 17 successively such that the yellow, magenta, cyan, and black toner images are superimposed on the same position on the intermediate transfer belt 17 in a primary transfer process to form a color toner image thereon.

After the primary transfer process, the outer circumferential surface of the respective photoconductive drums 11Y, 11M, 11C, and 11K reaches a cleaning position disposed opposite the cleaner 15. The cleaner 15 collects residual toner failed to be transferred onto the intermediate transfer belt 17 and therefore remaining on the outer circumferential surface of the respective photoconductive drums 11Y, 11M, 11C, and 11K therefrom in a cleaning process.

Thereafter, a discharger discharges the outer circumferential surface of the respective photoconductive drums 11Y, 11M, 11C, and 11K, finishing a series of image forming processes performed on the photoconductive drums 11Y, 11M, 11C, and 11K.

As the intermediate transfer belt 17 rotates clockwise in FIG. 1 in a rotation direction D17, the color toner image formed by the yellow, magenta, cyan, and black toner images superimposed on the intermediate transfer belt 17 reaches a secondary transfer nip formed between the intermediate transfer belt 17 and the secondary transfer bias roller 18. At the secondary transfer nip, the color toner image formed on the intermediate transfer belt 17 is secondarily transferred onto a recording medium in a secondary transfer process.

Thereafter, the outer circumferential surface of the intermediate transfer belt 17 reaches a cleaning position disposed opposite the intermediate transfer belt cleaner 16. The intermediate transfer belt cleaner 16 removes and collects residual toner failed to be transferred onto the recording medium and therefore remaining on the intermediate transfer belt 17 therefrom, finishing a series of transfer processes performed on the intermediate transfer belt 17.

The registration roller pair 9 and the like convey the recording medium conveyed from one of the paper trays 7 to the secondary transfer nip formed between the intermediate transfer belt 17 and the secondary transfer bias roller 18.

For example, one of a plurality of feed rollers 8 picks up and feeds the recording medium from the paper tray 7 loading the plurality of recording media to the registration roller pair 9 through a conveyance guide. The registration roller pair 9 serving as a timing roller pair feeds the recording medium to the secondary transfer nip at a time when the color toner image formed on the intermediate transfer belt 17 reaches the secondary transfer nip.

The conveyance belt 19 conveys the recording medium bearing the color toner image to the fixing device 20. The fixing device 20 includes a fixing belt and a pressure roller pressed against the fixing belt to form a fixing nip therebetween. As the recording medium bearing the color toner image is conveyed through the fixing nip, the fixing belt and the pressure roller fix the color toner image on the recording medium in a fixing process.

The conveyance roller pair 6 conveys the recording medium bearing the fixed color toner image to an output roller pair that ejects the recording medium bearing the fixed color toner image onto an outside of the image forming apparatus 1, thus finishing a series of image forming processes.

If a user selects a duplex print mode to print on both sides, that is, a front side and a back side, of the recording medium by duplex printing, the recording medium bearing the fixed toner image on the front side thereof is conveyed to the duplex device 80, not to the outside of the image forming apparatus 1. The duplex device 80 reverses the recording medium and conveys the recording medium to the secondary transfer nip through the registration roller pair 9. As the recording medium is conveyed through the secondary transfer nip, the secondary transfer bias roller 18 secondarily transfers another toner image formed in the image forming processes described above from the intermediate transfer belt 17 onto the back side of the recording medium. Thereafter, the fixing device 20 fixes the toner image on the back side of the recording medium. The conveyance roller pair 6 conveys the recording medium bearing the fixed toner image to the output roller pair that ejects the recording medium bearing the fixed toner image onto the outside of the image forming apparatus 1.

A description is provided of a construction of the fixing device 20 incorporated in the image forming apparatus 1.

Figure 2:
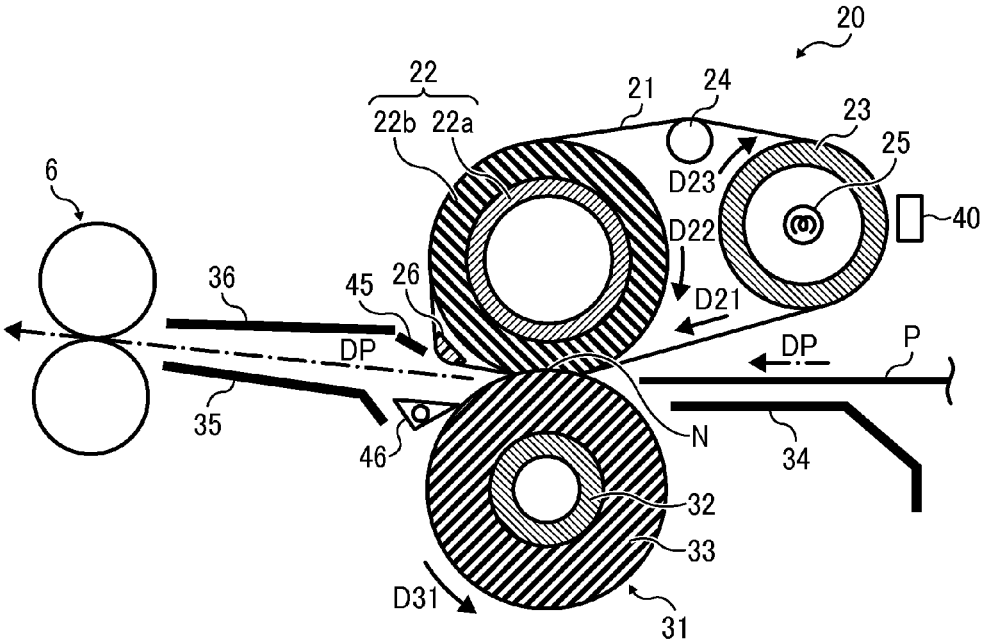
FIG. 2 is a schematic vertical sectional view of a fixing device incorporated in the image forming apparatus shown in FIG. 1.

FIG. 2 is a schematic vertical sectional view of the fixing device 20. As shown in FIG. 2, the fixing device 20 (e.g., a fuser or a fusing unit), employing a belt fixing method, includes a supplementary fixing roller 22 serving as a fixing roller, a heating roller 23, a fixing belt 21 serving as a fixing rotator, a tension roller 24, a separation pad 26 serving as an abutment, a pressure roller 31 serving as a pressure rotator, a temperature sensor 40, a fixing separation plate 45 serving as a fixing rotator side separator, a separation claw 46 serving as a pressure rotator side separator, an entry guide plate 34, a fixing guide plate 36 (e.g., an upper guide plate) serving as a guide, and a pressure guide plate 35 (e.g., a lower guide plate).

A detailed description is now given of a configuration of the fixing belt 21.

The fixing belt 21 serving as a fixing rotator rotatable in a rotation direction D21 is a multi-layer endless belt constructed of a base layer, an elastic layer coating the base layer, and a release layer coating the elastic layer. The base layer is made of resin. The elastic layer is made of an elastic material such as fluoro rubber, silicone rubber, and silicone rubber foam. The release layer is made of tetrafluoroethylene-perfluoroalkylvinylether copolymer (PFA), polyimide (PI), polyether imide (PEI), polyether sulfide (PES), or the like. The release layer serving as a surface layer of the fixing belt 21 facilitates separation or peeling-off of toner of a toner image on a recording medium P from the fixing belt 21. The fixing belt 21 is stretched taut across and supported by the three rollers, that is, the supplementary fixing roller 22, the heating roller 23, and the tension roller 24, and the separation pad 26 serving as an abutment. The fixing belt 21 is rotatable clockwise in FIG. 2 in the rotation direction D21. The tension roller 24 contacting an inner circumferential surface of the fixing belt 21 places a given tension to the fixing belt 21. The fixing belt 21 having a decreased thermal capacity facilitates temperature increase of the fixing device 20.

A detailed description is now given of a configuration of the supplementary fixing roller 22.

The supplementary fixing roller 22 serving as a fixing roller is constructed of a cored bar 22*a* made of SUS 304 stainless steel or the like and an elastic layer 22*b* coating the cored bar 22*a* and made of silicone rubber foam. The elastic layer 22*b* has a layer thickness of about 15 mm and an Asker C hardness in a range of from about 25 to about 50. The supplementary fixing roller 22 presses against the pressure roller 31 via the fixing belt 21 to form a fixing nip N between the fixing belt 21 and the pressure roller 31. The elastic layer 22*b* made of foam increases a length of the fixing nip N in a recording medium conveyance direction DP and reduces heat conducted from the fixing belt 21 to the supplementary fixing roller 22. A shaft of the supplementary fixing roller 22 is connected to a driving motor that drives and rotates the supplementary fixing roller 22 clockwise in FIG. 2 in a rotation direction D22.

According to this example embodiment, the elastic layer 22*b* is made of silicone rubber foam. Alternatively, the elastic layer 22*b* may be made of fluoro rubber, silicone rubber, or the like.

A detailed description is now given of a configuration of the heating roller 23.

The heating roller 23 rotatable in a rotation direction D23 is a hollow roller made of heat conductive metal such as aluminum. A heater 25 serving as a heater or a heat source is stationarily disposed inside the tubular heating roller 23. The heating roller 23 is treated with alumite coating to increase resistance against corrosion.

The heater 25 disposed inside the heating roller 23 includes a halogen heater. Both lateral ends of the heater 25 in a longitudinal direction thereof parallel to an axial direction of the fixing belt 21 are mounted on side plates of the fixing device 20, respectively. A power supply (e.g., an alternating current power supply) located inside the image forming apparatus 1 depicted in FIG. 1 controls the heater 25 to heat the heating roller 23 with radiation heat, which in turn heats the fixing belt 21. The fixing belt 21 heats the recording medium P bearing the toner image while the recording medium P contacts an outer circumferential surface of the fixing belt 21. Output of the heater 25 is controlled based on the temperature of the outer circumferential surface of the fixing belt 21 detected by the temperature sensor 40 (e.g., a thermopile) that is disposed opposite the outer circumferential surface of the fixing belt 21 without contacting the fixing belt 21. For example, the power supply supplies power of an alternating current voltage to the heater 25 for a given energization time period based on the temperature of the fixing belt 21 detected by the temperature sensor 40. Thus, the fixing belt 21 is heated to a desired fixing temperature, that is, a target control temperature, by the heater 25 controlled as described above.

A detailed description is now given of a configuration of the pressure roller 31.

The pressure roller 31, rotatable in a rotation direction D31, includes a cored bar 32 and an elastic layer 33 coating an outer circumferential surface of the cored bar 32 via an adhesion layer and having a layer thickness of about 3 mm. The elastic layer 33 is made of solid rubber such as fluoro rubber and silicone rubber. The pressure roller 31 is pressed against the supplementary fixing roller 22 via the fixing belt 21 to form the desired fixing nip N between the fixing belt 21 and the pressure roller 31.

Optionally, a thin release layer made of PFA or the like may coat an outer circumferential surface of the elastic layer 33. Additionally, a cleaning roller impregnated with silicone oil or the like may slide over an outer circumferential surface of the pressure roller 31. A pressurization mechanism may separably press the pressure roller 31 against the fixing belt 21.

A detailed description is now given of a configuration of the separation claw 46.

The separation claw 46 serving as a pressure rotator side separator is disposed downstream from the fixing nip N in the recording medium conveyance direction DP and in proximity to an exit of the fixing nip N. The separation claw 46 contacts the outer circumferential surface of the pressure roller 31. The separation claw 46 is made of fluoroplastic or the like. A biasing member (e.g., a spring) biases the separation claw 46 against the pressure roller 31 such that the separation claw 46 contacts the outer circumferential surface of the pressure roller 31 with relatively decreased pressure. A plurality of separation claws 46 is aligned in an axial direction of the pressure roller 31 and spaced apart from each other. Various separation claws may be employed as the separation claw 46. When the recording medium P is ejected from the fixing nip N along the outer circumferential surface of the pressure roller 31, the separation claw 46 serving as a pressure rotator side separator separates the recording medium P from the pressure roller 31. Thus, the separation claw 46 prevents the recording medium P ejected from the fixing nip N from being wound around the pressure roller 31 as the pressure roller 31 rotates in the rotation direction D31.

A detailed description is now given of a configuration of the separation pad 26.

The separation pad 26 serving as an abutment is disposed downstream from the fixing nip N in the rotation direction D21 of the fixing belt 21 or the recording medium conveyance direction DP. The separation pad 26 is interposed between the fixing belt 21 and the supplementary fixing roller 22 and in contact with the inner circumferential surface of the fixing belt 21. The separation pad 26 serving as an abutment abutting the fixing belt 21 at a position disposed downstream from the fixing nip N in the rotation direction D21 of the fixing belt 21 increases the curvature of the fixing belt 21. The separation pad 26 contacting the fixing belt 21 at the position disposed in proximity to the exit of the fixing nip N bends the fixing belt 21 at a curvature that is greater than a curvature of the supplementary fixing roller 22, facilitating separation (e.g., separation by the curvature of the fixing belt 21) of the recording medium P ejected from the fixing nip N from the fixing belt 21. Thus, the separation pad 26 prevents the recording medium P ejected from the fixing nip N from being wound around the fixing belt 21 as the fixing belt 21 rotates in the rotation direction D21.

For example, the separation pad 26 is a semi-cylinder made of resin and adhered with a slide sheet on an outer circumferential surface of the semi-cylinder. The slide sheet facilitates sliding of the fixing belt 21 over the separation pad 26.

A detailed description is now given of a configuration of the fixing separation plate 45.

The fixing separation plate 45 serving as a fixing rotator side separator is disposed opposite the separation pad 26 via the fixing belt 21. The fixing separation plate 45 is interposed between the fixing belt 21 and the fixing guide plate 36. The fixing separation plate 45 is disposed opposite the outer circumferential surface of the fixing belt 21 such that the fixing separation plate 45 does not contact at least a conveyance span on the fixing belt 21 in the axial direction thereof where the recording medium P is conveyed over the fixing belt 21. The conveyance span corresponds to a width of a maximum recording medium P available in the image forming apparatus 1.

Figure 3:
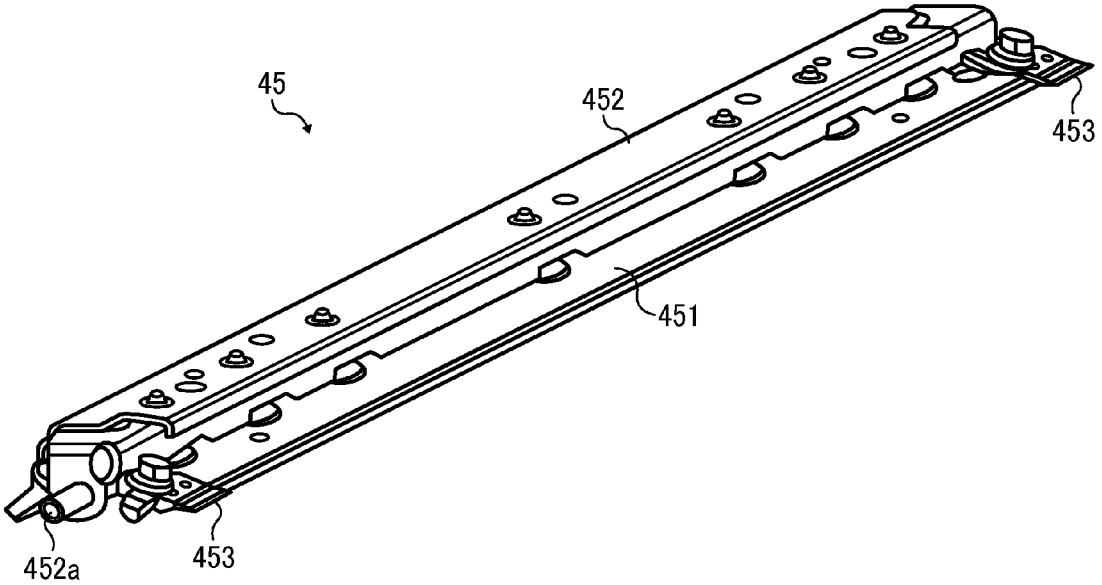
FIG. 3 is a perspective view of a fixing separation plate incorporated in the fixing device shown in FIG. 2.

FIG. 3 is a perspective view of the fixing separation plate 45. As shown in FIG. 3, the fixing separation plate 45 includes a body 451, a holding portion 452, and an abutment portion 453. The body 451 is made of fluoroplastic. The holding portion 452 holds the body 451. The abutment portion 453 is mounted on each lateral end of the body 451 in a longitudinal direction of the fixing separation plate 45 parallel to the axial direction of the fixing belt 21. The holding portion 452 is mounted on and supported by both side plates of the fixing device 20 through a plurality of shafts 452*a* projecting from both lateral ends of the holding portion 452 in the longitudinal direction of the fixing separation plate 45, respectively. The abutment portion 453 contacts a non-conveyance span on the fixing belt 21 in the axial direction thereof where the recording medium P is not conveyed over the fixing belt 21 so that the body 451 is disposed opposite the fixing belt 21 with a slight interval therebetween. Thus, the fixing separation plate 45 facilitates separation of the recording medium P ejected from the fixing nip N from the fixing belt 21. When the recording medium P is ejected from the fixing nip N along the outer circumferential surface of the fixing belt 21, the fixing separation plate 45 separates the recording medium P from the fixing belt 21.

Figure 4:
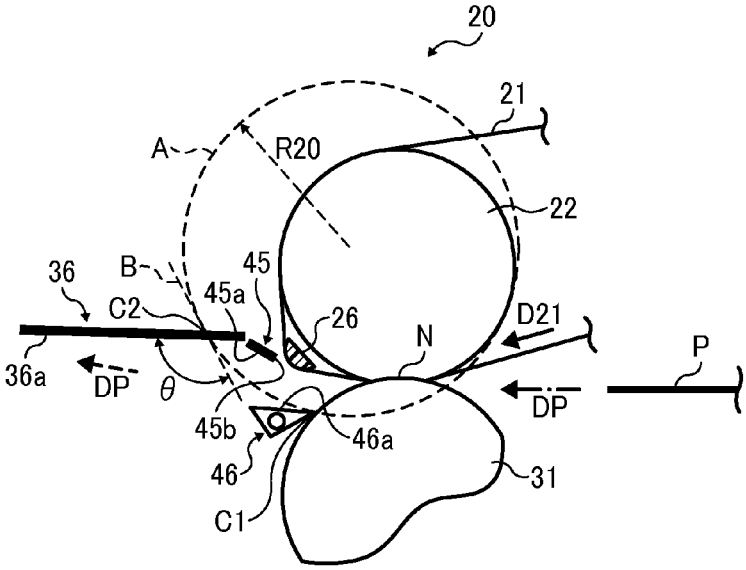
FIG. 4 is a partially enlarged sectional view of the fixing device shown in FIG. 2.

FIG. 4 is a partially enlarged sectional view of the fixing device 20. As shown in FIG. 4, the fixing separation plate 45 includes a separation-conveyance face 45*a* disposed opposite the recording medium P that is ejected from the fixing nip N and brought into contact with the separation-conveyance face 45*a* and an edge 45*b* disposed opposite the fixing belt 21. At least the separation-conveyance face 45*a* and the edge 45*b* are made of a material having a decreased friction coefficient. For example, the body 451 depicted in FIG. 3 is made of a material having a decreased friction coefficient such as fluoroplastic. A surface of the body 451 is coated with a material or tape having a decreased friction coefficient such as fluoroplastic. Thus, the recording medium P separated from the fixing belt 21 by the fixing separation plate 45 is conveyed over the separation-conveyance face 45*a* of the fixing separation plate 45 smoothly.

With reference to FIG. 2, a detailed description is now given of a configuration of the entry guide plate 34, the fixing guide plate 36, and the pressure guide plate 35.

The entry guide plate 34, disposed in proximity to an entry to the fixing nip N where the fixing belt 21 contacts the pressure roller 31, guides the recording medium P to the fixing nip N.

The fixing guide plate 36 (e.g., an upper guide plate) and the pressure guide plate 35 (e.g., a lower guide plate), disposed in proximity to the exit of the fixing nip N and downstream from the fixing nip N in the recording medium conveyance direction DP, guide the recording medium P ejected from the fixing nip N. The fixing guide plate 36 serving as a guide is disposed opposite a fixing side of the recording medium P ejected from the fixing nip N that bears the fixed toner image fixed on the recording medium P at the fixing nip N. Conversely, the pressure guide plate 35 is disposed opposite a non-fixing side of the recording medium P ejected from the fixing nip N that is opposite the fixing side of the recording medium P. The fixing guide plate 36 and the pressure guide plate 35 define a conveyance path through which the recording medium P is conveyed.

A detailed description of a configuration of the fixing guide plate 36 is deferred.

A description is provided of a fixing operation performed by the fixing device 20.

As shown in FIGS. 1 and 2, as the image forming apparatus 1 is powered on, the power supply supplies power of an alternating current voltage to the heater 25 and a driving motor drives and rotates the supplementary fixing roller 22 in the rotation direction D22. The supplementary fixing roller 22 rotates the fixing belt 21 in the rotation direction D21 by friction therebetween. The fixing belt 21 rotates the heating roller 23 in the rotation direction D23 by friction therebetween and the pressure roller 31 in the rotation direction D31 by friction therebetween.

Yellow, magenta, cyan, and black toner images formed on the photoconductive drums 11Y, 11M, 11C, and 11K, respectively, are transferred onto the intermediate transfer belt 17 and further transferred onto a recording medium P conveyed from the paper tray 7. Thus, the recording medium P bears an unfixed toner image. The recording medium P bearing the unfixed toner image is conveyed in the recording medium conveyance direction DP and enters the fixing nip N formed between the fixing belt 21 and the pressure roller 31 pressed against the fixing belt 21. The toner image is fixed on the recording medium P under heat from the fixing belt 21 heated by the heater 25 through the heating roller 23 and pressure exerted between the supplementary fixing roller 22 and the pressure roller 31 via the fixing belt 21. The recording medium P ejected from the fixing nip N by the fixing belt 21 rotating in the rotation direction D21 and the pressure roller 31 rotating in the rotation direction D31 is conveyed in the recording medium conveyance direction DP while guided by the two guide plates, that is, the upper, fixing guide plate 36 and the lower, pressure guide plate 35 disposed opposite the fixing guide plate 36, to the conveyance roller pair 6. The conveyance roller pair 6, as it rotates, conveys the recording medium P in the recording medium conveyance direction DP.

A description is provided of a configuration and an operation of the fixing device 20 in detail.

As described above with reference to FIGS. 2 and 4, the fixing guide plate 36 is disposed downstream from the fixing nip N in the recording medium conveyance direction DP and disposed opposite the fixing side of the recording medium P that bears the fixed toner image.

As shown in FIG. 4 illustrating a cross-section of the fixing device 20 that is perpendicular to the axial direction of the pressure roller 31, the fixing guide plate 36 includes a guide face 36*a* disposed opposite the recording medium P ejected from the fixing nip N to guide the recording medium P. A hypothetical circle A, having a curvature not smaller than 1/20 (l/mm), is defined by an opposed tip C1 of the separation claw 46 that contacts the pressure roller 31 and a separation-conveyance face 46*a* of the separation claw 46 that separates the recording medium P from the pressure roller 31. The opposed tip C1 defines an opposed point where the separation claw 46 contacts the pressure roller 31. The hypothetical circle A intersects the guide face 36*a* of the fixing guide plate 36 at an intersection C2. A hypothetical tangent B is tangent to the hypothetical circle A at the intersection C2. The guide face 36*a* and the tangent B define a downstream intersection angle θ that is downstream from the hypothetical tangent B in the recording medium conveyance direction DP and greater than 90 degrees.

The fixing guide plate 36 is positioned relative to the separation-conveyance face 46*a* of the separation claw 46 to define inclination of an upstream portion and a downstream portion of the fixing guide plate 36 in the recording medium conveyance direction DP and a length of the fixing guide plate 36 in the recording medium conveyance direction DP that defines a position of the fixing guide plate 36 relative to the fixing separation plate 45 such that the downstream intersection angle θ is an obtuse angle in a range of from about 90 degrees to about 180 degrees. The downstream intersection angle θ produced at a position downstream from the hypothetical tangent B in the recording medium conveyance direction DP is defined by the guide face 36*a* of the fixing guide plate 36 and the hypothetical tangent B tangent to the hypothetical circle A at the intersection C2 where the hypothetical circle A having a radius of curvature not greater than R20 mm intersects the guide face 36*a* of the fixing guide plate 36.

Accordingly, even when duplex printing is performed with a thin recording medium P having a decreased thickness (e.g., thin paper), a substantially curled leading end of the thin recording medium P is not caught on the fixing guide plate 36 after the separation claw 46 separates the thin recording medium P from the pressure roller 31.

Figure 5A:
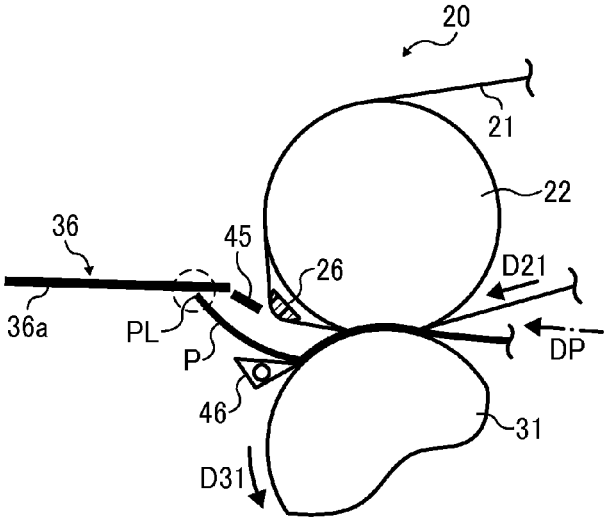
FIG. 5A is a partial sectional view of the fixing device shown in FIG. 4 illustrating a thin recording medium that comes into contact with a fixing guide plate incorporated in the fixing device.

For example, the thin recording medium P having a decreased rigidity is susceptible to face curl in which the thin recording medium P is curled into a recess facing the fixing belt 21 by heat from the fixing belt 21 after the thin recording medium P passes through the fixing nip N. While the toner image on the back side, that is, a second side, of the thin recording medium P is fixed on the thin recording medium P during duplex printing, the toner image fixed on the front side, that is, a first side, of the thin recording medium P is half melted as it is heated at the fixing nip N, thus being susceptible to adhesion to the pressure roller 31. FIG. 5A is a partial sectional view of the fixing device 20 illustrating the thin recording medium P that comes into contact with the fixing guide plate 36.

Figure 5B:
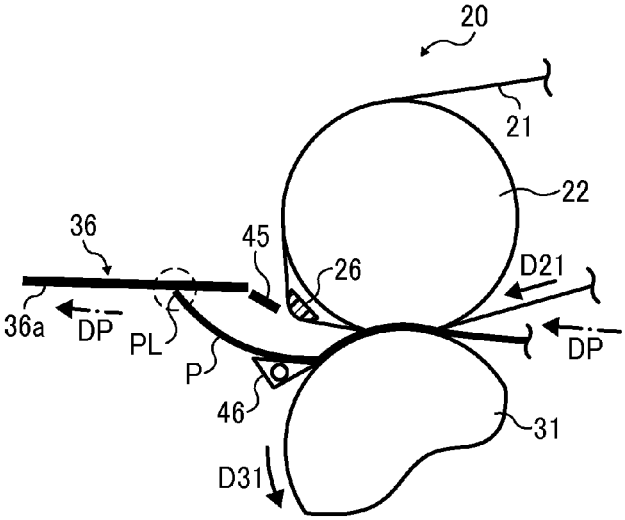
FIG. 5B is a partial sectional view of the fixing device shown in FIG. 4 illustrating the thin recording medium that is conveyed over the fixing guide plate.
Figure 6:
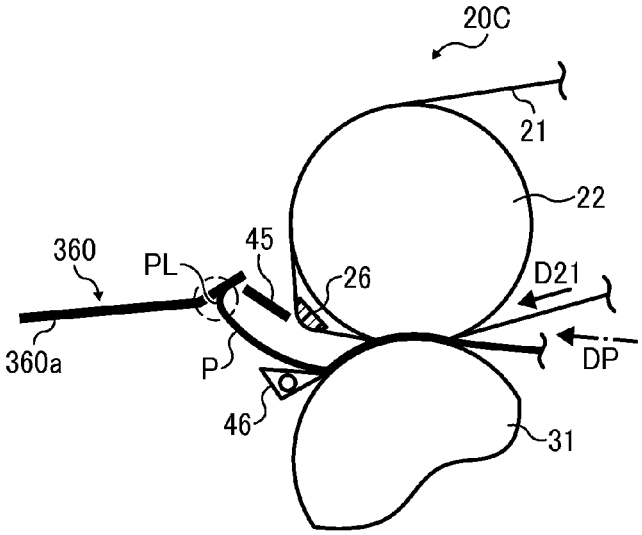
FIG. 6 is a partial sectional view of a comparative fixing device.

FIG. 5B is a partial sectional view of the fixing device 20 illustrating the thin recording medium P that is conveyed over the fixing guide plate 36. As shown in FIG. 5A, during fixing of the toner image on the back side of the thin recording medium P, while the thin recording medium P is ejected from the fixing nip N, the thin recording medium P moves along the outer circumferential surface of the pressure roller 31 rotating in the rotation direction D31 in a state in which the thin recording medium P is adhered to the pressure roller 31 and a leading end PL of the thin recording medium P that is indicated in a dotted circle is curled substantially into a face curl having a radius of curvature not greater than R20 mm. The curled leading end PL of the thin recording medium P is separated from the pressure roller 31 by the separation claw 46 and brought into contact with the fixing guide plate 36. However, as described above, the guide face 36*a* of the fixing guide plate 36 and the hypothetical tangent B tangent to the hypothetical circle A having the radius of curvature not greater than R20 mm define the obtuse intersection angle θ. Accordingly, as shown in FIG. 5B, even if the curled leading end PL of the thin recording medium P strikes the fixing guide plate 36, the leading end PL of the thin recording medium P is not caught on the guide face 36*a* of the fixing guide plate 36. Thus, the thin recording medium P is conveyed while sliding over the guide face 36*a* of the fixing guide plate 36. FIG. 6 is a partial sectional view of a comparative fixing device 20C. As shown in FIG. 6, the comparative fixing device 20C includes an upper, fixing guide plate 360 that does not define the downstream intersection angle θ. After the separation claw 46 separates the thin recording medium P from the pressure roller 31, the substantially curled leading end PL of the thin recording medium P, as it strikes the fixing guide plate 360, may be caught on a guide face 360*a* of the fixing guide plate 360 and jammed.

As shown in FIG. 4, the curvature of the hypothetical circle A is not smaller than 1/20 (1/mm) because the leading end PL of the recording medium P, even if it is produced with a small face curl having a curvature smaller than 1/20 (1/mm), is barely caught on the fixing guide plate 36 as it strikes the fixing guide plate 36.

The curvature of the hypothetical circle A is not smaller than 1/20 (1/mm) and not greater than 1/15 (1/mm). It is because a substantial face curl having a curvature greater than 1/15 (1/mm) is barely produced.

According to this example embodiment shown in FIG. 4, the guide face 36*a* of the fixing guide plate 36 is made of a material having a decreased friction coefficient. For example, the fixing guide plate 36 is made of a material having a decreased friction coefficient such as fluoroplastic. The guide face 36*a* of the fixing guide plate 36 is coated with a material or tape having a decreased friction coefficient such as fluoroplastic. Thus, as shown in FIGS. 5A and 5B, even if the leading end PL of the recording medium P strikes the guide face 36*a* of the fixing guide plate 36, the recording medium P is conveyed along the guide face 36*a* of the fixing guide plate 36 smoothly.

Figure 7:
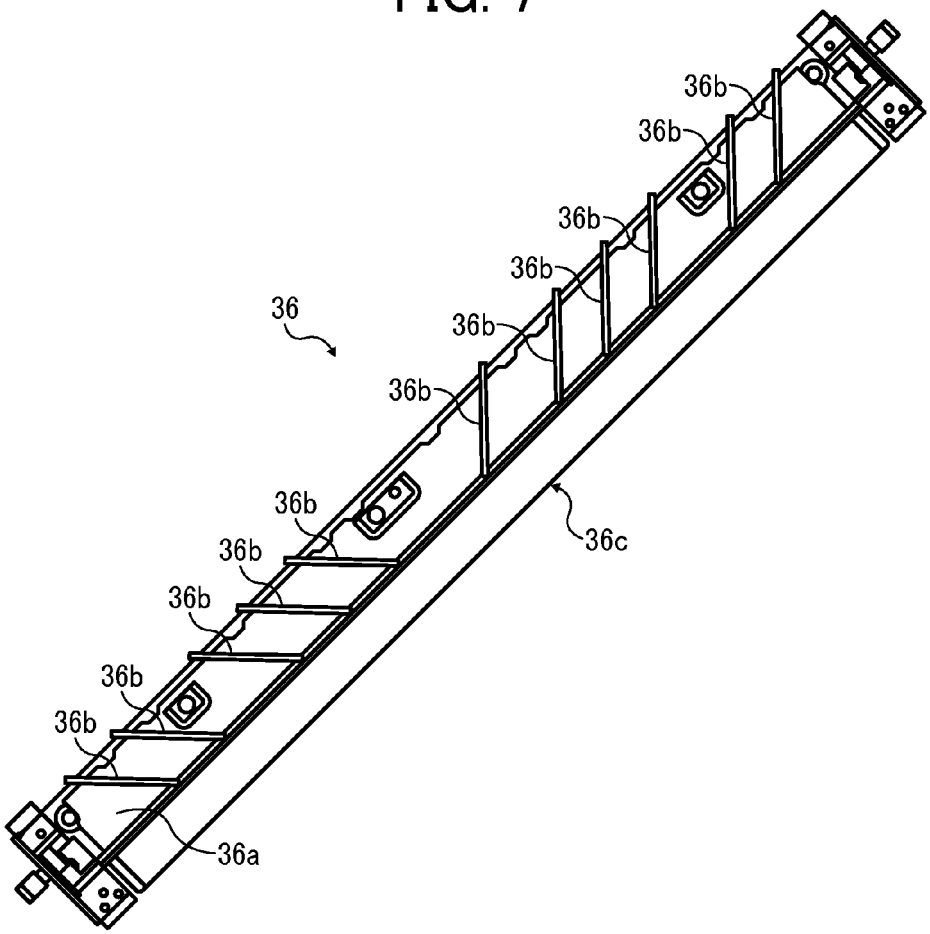
FIG. 7 is a plan view of the fixing guide plate installable in the fixing device shown in FIG. 2, which mounts a plurality of ribs.

FIG. 7 is a plan view of the fixing guide plate 36. Optionally, as shown in FIG. 7, the guide face 36*a* of the fixing guide plate 36 mounts a plurality of ribs 36*b* made of a material having a decreased friction coefficient and extended substantially in the recording medium conveyance direction DP. According to this example embodiment, the guide face 36*a* of the fixing guide plate 36 mounts eleven ribs 36*b* disposed downstream from a front edge 36*c* disposed opposite the fixing belt 21 in the recording medium conveyance direction DP. The recording medium P is conveyed over the plurality of ribs 36*b* along the guide face 36*a* of the fixing guide plate 36 smoothly.

The fixing separation plate 45 depicted in FIG. 4 may be disposed opposite the conveyance span on the outer circumferential surface of the fixing belt 21 with a variable interval therebetween.

Figure 8:
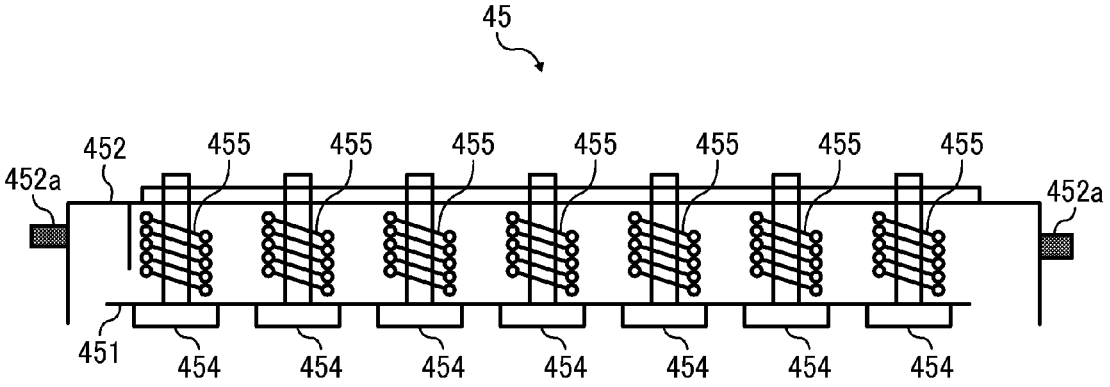
FIG. 8 is a sectional view of the fixing separation plate shown in FIG. 3.

FIG. 8 is a sectional view of the fixing separation plate 45. As shown in FIG. 8, the body 451 is secured to the holding portion 452 through a plurality of screws 454 around which a plurality of compression springs 455 is coiled, respectively. The plurality of screws 454 and the plurality of compression springs 455 are aligned in the axial direction of the fixing belt 21. The plurality of screws 454 is tightened to decrease the interval between the fixing separation plate 45 and the fixing belt 21 throughout an axial span of the fixing belt 21. Conversely, the plurality of screws 454 is loosened to increase the interval between the fixing separation plate 45 and the fixing belt 21 throughout the axial span of the fixing belt 21. The plurality of screws 454 is tightened and loosened separately from each other to adjust variation in the interval between the fixing separation plate 45 and the fixing belt 21 that varies in the axial direction of the fixing belt 21. Thus, the fixing separation plate 45 further facilitates separation of the recording medium P ejected from the fixing nip N from the fixing belt 21.

As described above with reference to FIG. 4, the fixing guide plate 36 serving as a guide is disposed downstream from the fixing nip N in the recording medium conveyance direction DP and disposed opposite the fixing side of the recording medium P that is disposed opposite the fixing belt 21. When seen in a cross-section perpendicular to the axial direction of the pressure roller 31 serving as a pressure rotator, the hypothetical circle A has a curvature not smaller than 1/20 (1/mm). The hypothetical circle A is defined by the opposed tip C1 of the separation claw 46 serving as a pressure rotator side separator that contacts the pressure roller 31 and the separation-conveyance face 46*a* of the separation claw 46. The hypothetical circle A intersects the guide face 36*a* of the fixing guide plate 36 at the intersection C2. The hypothetical tangent B is tangent to the hypothetical circle A at the intersection C2. The guide face 36*a* and the hypothetical tangent B define the downstream intersection angle θ that is downstream from the hypothetical tangent B in the recording medium conveyance direction DP and greater than 90 degrees. Accordingly, as shown in FIGS. 5A and 5B, even when duplex printing is performed with a thin recording medium P having a decreased thickness (e.g., thin paper), the substantially curled leading end PL of the thin recording medium P is not caught on the fixing guide plate 36 after the separation claw 46 separates the thin recording medium P from the pressure roller 31.

A description is provided of variation and modification of the fixing device 20.

As shown in FIG. 2, according to the example embodiments described above, the pressure roller 31 serves as a pressure rotator. Alternatively, a pressure belt or the like may be used as a pressure rotator. The fixing belt 21 serves as a fixing rotator. Alternatively, a fixing roller, a fixing film, a fixing sleeve, or the like may be used as a fixing rotator. The separation pad 26 serving as an abutment contacts the fixing belt 21. Alternatively, the separation pad 26 may be removed from the fixing device 20.

The heater 25 serves as a heater that heats the fixing rotator (e.g., the fixing belt 21). Alternatively, an exciting coil installable in fixing devices employing an electromagnetic induction heating method or a resistance heat generator may be used as a heater for heating the fixing rotator.

In those cases also, the fixing device 20 attains advantages equivalent to the advantages described above.

According to the example embodiments described above, a driver (e.g., a driving motor) drives and rotates the fixing rotator (e.g., the fixing belt 21) which in turn drives and rotates the pressure rotator (e.g., the pressure roller 31). Alternatively, the driver may drive and rotate the pressure rotator which in turn drives and rotates the fixing rotator. Yet alternatively, the driver may drive and rotate the fixing rotator and the pressure rotator separately.

As shown in FIG. 4, the separation claw 46 serving as a pressure rotator side separator is disposed downstream from the fixing nip N in the recording medium conveyance direction DP and in contact with an outer circumferential surface of the pressure rotator. Alternatively, a separation plate serving as a pressure rotator side separator may be disposed downstream from the fixing nip N in the recording medium conveyance direction DP and disposed opposite the outer circumferential surface of the pressure rotator with a slight interval therebetween. In this case, for example, the hypothetical circle A has a curvature not smaller than 1/20 (1/mm) and is defined by the opposed tip C1 of the separation claw 46 disposed in proximity to the pressure roller 31 with the slight interval therebetween and the separation-conveyance face 46*a* of the separation claw 46. The opposed tip C1 defines an opposed point where the separation claw 46 is disposed opposite the pressure roller 31.

In those cases also, the fixing device 20 attains advantages equivalent to the advantages described above.

A description is provided of advantages of the fixing device 20.

As described above with reference to FIG. 4, the fixing device 20 includes a fixing rotator (e.g., the fixing belt 21) to heat a recording medium P to fix a toner image on the recording medium P; a pressure rotator (e.g., the pressure roller 31) pressed against the fixing rotator to form the fixing nip N therebetween, through which the recording medium P is conveyed; a pressure rotator side separator (e.g., the separation claw 46) disposed downstream from the fixing nip N in the recording medium conveyance direction DP and disposed opposite or in contact with the outer circumferential surface of the pressure rotator to separate the recording medium P from the pressure rotator; and a guide (e.g., the fixing guide plate 36) disposed downstream from the fixing nip N in the recording medium conveyance direction DP and disposed opposite the fixing side of the recording medium P that is disposed opposite the fixing rotator to guide the recording medium P ejected from the fixing nip N. When seen in a cross-section perpendicular to an axial direction of the pressure rotator, the hypothetical circle A has a curvature not smaller than 1/20 (1/mm). The hypothetical circle A is defined by the opposed tip C1, that is, an opposed point, of the pressure rotator side separator that is in contact with or disposed opposite the pressure rotator and the separation-conveyance face 46*a* of the pressure rotator side separator. The hypothetical circle A intersects the guide face 36*a* of the guide at the intersection C2. The hypothetical tangent B is tangent to the hypothetical circle A at the intersection C2. The guide face 36*a* and the hypothetical tangent B define the downstream intersection angle θ that is downstream from the hypothetical tangent B in the recording medium conveyance direction DP and greater than 90 degrees.

Accordingly, as shown in FIGS. 5A and 5B, even when duplex printing is performed with a thin recording medium P having a decreased thickness (e.g., thin paper), the substantially curled leading end PL of the thin recording medium P is not caught on the guide after the pressure rotator side separator separates the thin recording medium P from the pressure rotator.

The present disclosure has been described above with reference to specific example embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative example embodiments may be combined with each other and/or substituted for each other within the scope of the present disclosure.

What is claimed is:

1. A fixing device comprising:

a fixing rotator rotatable in a direction of rotation, and conveyable around a fixing roller;

a pressure rotator, configured to be pressed against the fixing rotator to form a fixing nip therebetween, through which a recording medium bearing a toner image is conveyable;

a guide, disposed downstream from the fixing nip in a recording medium conveyance direction and disposed opposite a fixing side of the recording medium disposed opposite the fixing rotator, the guide including a guide face to guide the recording medium after ejection from the fixing nip;

a pressure rotator side separator disposed downstream from the fixing nip in the recording medium conveyance direction, the pressure rotator side separator including:

an opposed tip disposed opposite an outer circumferential surface of the pressure rotator; and a separation-conveyance face to separate the recording medium from the pressure rotator, the opposed tip and the separation-conveyance face of the pressure rotator side separator defining a hypothetical circle having a curvature not smaller than 1/20 that intersects the guide face of the guide at an intersection at which a hypothetical tangent is tangent to the hypothetical circle, the hypothetical tangent and the guide face of the guide defining a downstream intersection angle that is downstream from the hypothetical tangent in the recording medium conveyance direction and is greater than 90 degrees.

2. The fixing device according to claim 1, wherein the curvature of the hypothetical cycle is not greater than 1/15.

3. The fixing device according to claim 1, wherein the guide face of the guide is made of a material having a decreased friction coefficient.

4. The fixing device according to claim 1, further comprising a plurality of ribs mounted on the guide face of the guide and made of a material having a decreased friction coefficient, the plurality of ribs extending substantially in the recording medium conveyance direction.

5. A fixing device, comprising:

a fixing rotator rotatable in a direction of rotation;

a pressure rotator, configured to be pressed against the fixing rotator to form a fixing nip therebetween, through which a recording medium bearing a toner image is conveyable;

a guide, disposed downstream from the fixing nip in a recording medium conveyance direction and disposed opposite a fixing side of the recording medium disposed opposite the fixing rotator, the guide including a guide face to guide the recording medium after ejection from the fixing nip;

a pressure rotator side separator disposed downstream from the fixing nip in the recording medium conveyance direction, the pressure rotator side separator including an opposed tip disposed opposite an outer circumferential surface of the pressure rotator, and a separation-conveyance face to separate the recording medium from the pressure rotator, the opposed tip and the separation-conveyance face of the pressure rotator side separator defining a hypothetical circle having a curvature not smaller than 1/20 that intersects the guide face of the guide at an intersection at which a hypothetical tangent is tangent to the hypothetical circle, the hypothetical tangent and the guide face of the guide defining a downstream intersection angle that is downstream from the hypothetical tangent in the recording medium conveyance direction and is greater than 90 degrees; and a fixing rotator side separator interposed between the fixing rotator and the guide and disposed opposite an outer circumferential surface of the fixing rotator in a conveyance span on the fixing rotator in an axial direction thereof where the recording medium is conveyed over the fixing rotator with an interval between the fixing rotator side separator and the fixing rotator.

6. The fixing device according to claim 5, wherein the interval between the fixing rotator side separator and the fixing rotator is variable.

7. The fixing device according to claim 5, wherein the fixing rotator side separator includes:

a separation-conveyance face disposed opposite the recording medium ejected from the fixing nip and made of a material having a decreased friction coefficient; and an opposed edge disposed opposite the fixing rotator and made of a material having a decreased friction coefficient.

8. The fixing device according to claim 5, wherein the fixing rotator includes a fixing belt.

9. The fixing device according to claim 8, further comprising:

a fixing roller, over which the fixing belt is stretched taut, to press against the pressure rotator via the fixing belt to form the fixing nip; and an abutment disposed downstream from the fixing nip in the recording medium conveyance direction and interposed between the fixing roller and the fixing belt, the abutment contacting an inner circumferential surface of the fixing belt to increase a curvature of the fixing belt, wherein the fixing rotator side separator is disposed opposite the abutment via the fixing belt.

10. The fixing device according to claim 5, wherein the fixing rotator side separator includes a separation plate.

11. The fixing device according to claim 5, wherein the fixing rotator side separator includes:

a body;

a holding portion to hold the body; and an abutment portion mounted on each lateral end of the body in a longitudinal direction of the fixing rotator side separator and contacting the fixing rotator.

12. The fixing device according to claim 11, wherein the abutment portion contacts a non-conveyance span on the fixing rotator in the axial direction thereof where the recording medium is not conveyed over the fixing rotator, and wherein the body is disposed opposite the fixing rotator with the interval therebetween.

13. The fixing device according to claim 12, wherein the fixing rotator side separator further includes:

a plurality of screws to secure the body to the holding portion; and a plurality of compression springs coiled around the plurality of screws, respectively, and wherein the plurality of screws is tightened and loosened to change the interval between the fixing rotator side separator and the fixing rotator.

14. The fixing device according to claim 13, wherein the plurality of screws and the plurality of compression springs are aligned in the axial direction of the fixing rotator.

15. The fixing device according to claim 1, wherein the opposed tip of the pressure rotator side separator contacts the outer circumferential surface of the pressure rotator.

16. The fixing device according to claim 1, wherein the pressure rotator side separator further includes a separation claw.

17. The fixing device according to claim 1, wherein the guide further includes a guide plate.

18. The fixing device according to claim 1, wherein the pressure rotator includes a pressure roller.

19. An image forming apparatus comprising:

an image bearer to bear a toner image; and a fixing device, disposed downstream from the image bearer in a recording medium conveyance direction, to fix the toner image on a recording medium, the fixing device including:

a fixing rotator rotatable in a direction of rotation;

a pressure rotator, configured to be pressed against the fixing rotator to form a fixing nip therebetween, through which the recording medium bearing the toner image is conveyable;

a guide, disposed downstream from the fixing nip in the recording medium conveyance direction and disposed opposite a fixing side of the recording medium disposed opposite the fixing rotator, the guide including a guide face to guide the recording medium after ejection from the fixing nip;

a pressure rotator side separator disposed downstream from the fixing nip in the recording medium conveyance direction, the pressure rotator side separator including an opposed tip disposed opposite an outer circumferential surface of the pressure rotator; and a separation-conveyance face to separate the recording medium from the pressure rotator, the opposed tip and the separation-conveyance face of the pressure rotator side separator defining a hypothetical circle having a curvature not smaller than 1/20 that intersects the guide face of the guide at an intersection at which a hypothetical tangent is tangent to the hypothetical circle, the hypothetical tangent and the guide face of the guide defining a downstream intersection angle that is downstream from the hypothetical tangent in the recording medium conveyance direction and is greater than 90 degrees.

20. The fixing device according to claim 1, further comprising:

a separation pad, disposed between the fixing rotator and the fixing roller, to facilitate separation of the recording medium, after ejection from the fixing nip, from the fixing rotator.

* * * * *